United States Patent [19]

Watkiss

[11] 3,989,234

[45] Nov. 2, 1976

[54] COLLATING MACHINES

[76] Inventor: Christopher Robin Watkiss, Holme Court, Biggleswade, Bedfordshire, England

[22] Filed: July 9, 1974

[21] Appl. No.: 486,799

[30] Foreign Application Priority Data

July 10, 1973 United Kingdom ..... 32757/73

[52] U.S. Cl. ..... 270/58

[51] Int. Cl.[2] ..... B65H 39/045

[58] Field of Search ..... 270/58, 56; 271/9

[56] References Cited

UNITED STATES PATENTS

| | | | |
|---|---|---|---|
| 715,890 | 12/1902 | Smyth et al. | 270/58 |
| 2,089,861 | 8/1937 | Schlensker | 270/58 |
| 3,193,284 | 7/1965 | Kretz | 270/58 |
| 3,350,089 | 10/1967 | Niccoli | 270/58 |
| 3,540,721 | 11/1970 | Blowsky | 270/58 |

*Primary Examiner*—Edgar S. Burr
*Assistant Examiner*—A. Heinz
*Attorney, Agent, or Firm*—Seidel, Gonda & Goldhammer

[57] ABSTRACT

A collating machine comprises a plurality of bins for flexible sheets of material arranged in series on an arc of a circle, a sheet pick-up device above the bins, and a drive system to cause relative rotary movement between the bins and the pick-up device to cause single sheets from individual bins to be collected progressively at the pick-up device to form a collated set as the relative rotary movement occurs. Preferably, the bins are moved in a circle relative to the pick-up device. Detector means may also be provided to indicate when a bin becomes empty or when there is a mis-feed of the sheets.

15 Claims, 4 Drawing Figures

COLLATING MACHINES

BACKGROUND TO THE INVENTION

This invention relates to machines for collating flexible sheets of material such as paper, card, etc. from a plurality of stacks of such sheets into sets containing one sheet from each stack, for example in assembling the pages of a book, catalogue, or the like.

DESCRIPTION OF THE PRIOR ART

Conventional collating machines generally consist of a plurality of receptacles for the individual stacks, with the receptacles arranged in a linear row. The sheets are pushed up from the stacks into a conveyor at the top of the row of receptacles, and form a set as they drop from the end of the conveyor. This takes up a considerable amount of space, the receptacles require individual adjustment when being loaded with sheets, and the machines cannot accept different thicknesses and textures of sheet in the respective receptacles for collation into one set.

SUMMARY OF THE INVENTION

The present invention provides a collating machine which occupies a minimum of space, and in which the receptacles may be moved relative to a sheet collection device. Moreover, the machine may be made substantially of plastics material to operate almost noiselessly. The sheets are arranged to be dropped into the receptacles without any need for adjustment and odd shaped sheets can be handled without difficulty. The machine will also collate sheets of different thickness and/or texture in successive receptacles or bins.

In accordance with the present invention there is provided a collating machine comprising a plurality of bins located in series on an arc of a circle and each arranged to hold a stack of sheets, a sheet pick-up device adjacent to said bins, and drive means arranged to effect relative rotary movement between the bins and said pick-up device to cause single sheets from individual ones of said bins to be collected progressively at said pick-up device to form a collated set as said relative rotary movement occurs.

Preferably, the sheet pick-up device is mounted in a stationary position and said bins are rotatable around said circular arc relative to the pick-up device.

In a preferred arrangement, each bin is formed between an adjacent pair of a plurality of partitions which are rigidly mounted around a circular support member and which are each inclined at a common angle to a plane perpendicular to the axis of rotational symmetry of the support member.

The pick-up device preferably comprises a collecting shoe resiliently suspended above the bins such that its lower surface, which may be provided with a layer of friction material, slides over a conically tapered roller rotatably mounted above each partition on a spindle whose axis lies on a radius of the support member, such as a table.

The uppermost sheet in each bin is fed in turn to engage the respective roller of its bin just before said roller passes under the collecting shoe so that the shoe can entrain each uppermost sheet in turn to eventually form a collated set of sheets which may be deposited on a receiving tray as the tray passes under the shoe.

Separately collated sets may be separated from each other on the tray by means of dividing sheets of which a stack may be accommodated in an appropriate bin.

Alternatively, the sets may be separated from each other by depositing them on the tray offset at an angle to each other. This may be achieved either by rotating the tray with respect to the shoe, or vice-versa, each time the tray and shoe pass to receive a collated set. A spring strip upstanding from each partition is suitably provided for each bin to prevent the leading edge of an upstanding uppermost sheet from bending downwardly into the next bin.

It is preferable to incorporate in the machine a detector system which stops the drive means and/or provides a warning should a bin become prematurely empty before the required number of sets have been collated or should an uppermost sheet of one bin entrain at least the next sheet in its stack in partial overlapping relationship as it is entrained by the collecting shoe so that an operator may either replenish the empty bin or disengage the or each incorrectly entrained sheet, as the case may be, whilst the table is stationary.

BRIEF DESCRIPTION OF THE DRAWINGS

A collating machine in accordance with the invention will now be described by way of example and with reference to the accompanying drawings, in which.

DESCRIPTION OF THE PREFERRED EMBODIMENT

Figure 1:
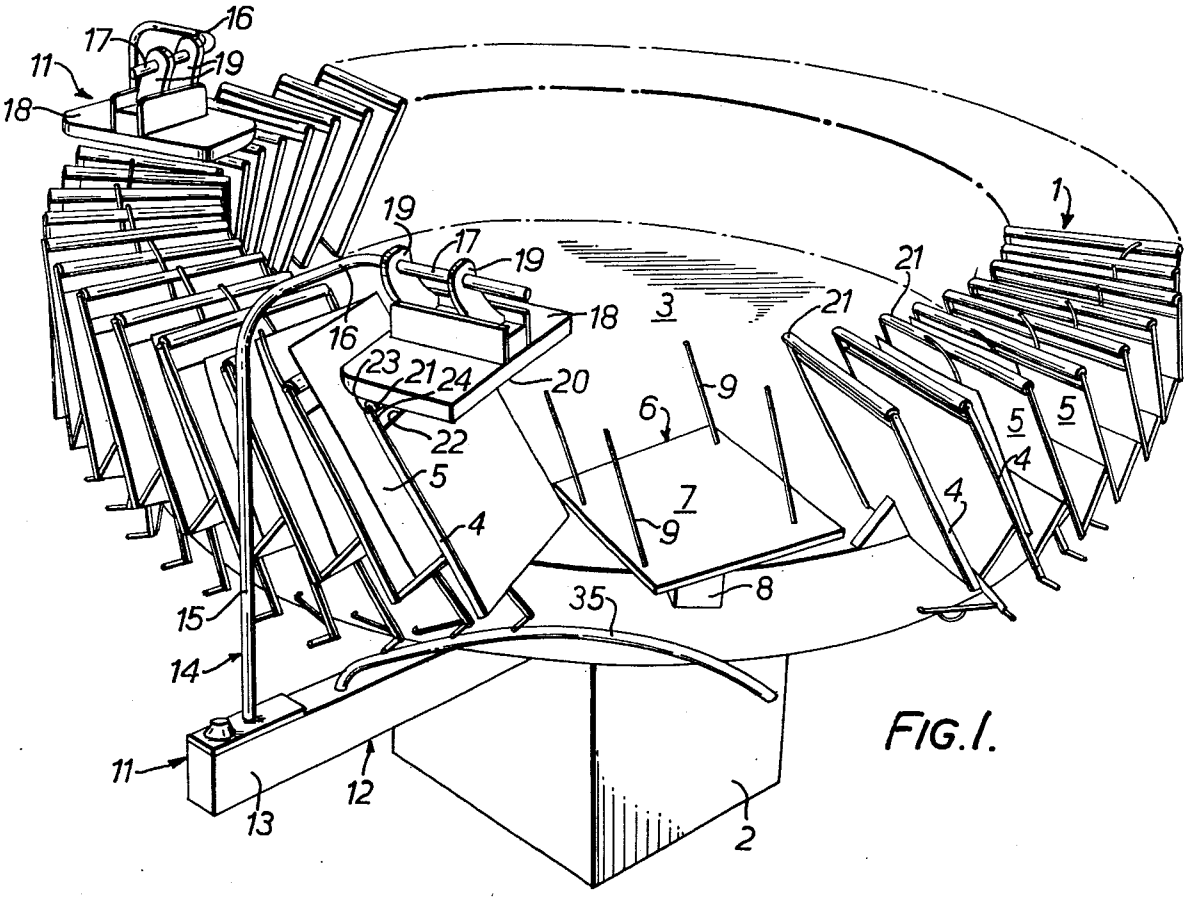
FIG. 1 is a perspective view of the collating machine.

Referring to FIG. 1, a collating machine indicated generally at 1 comprises a rigid supporting base 2 in which is mounted a variable speed electric motor (not shown) with its output drive shaft pointing vertically upwards. A circular table 3 has its centre mounted on the shaft of the motor by means of a universal joint (not shown) such that the table can be rotated in a substantially horizontal plane about its centre by the motor but can undergo limited pivotal movement about a horizontal axis passing through its centre. Around the periphery of the table 3 are arranged planar partitions 4 which are supported rigidly on the table with their major planes inclined at a predetermined angle to the vertical. The partitions 4 are spaced to define bins 5 between adjacent pairs of partitions for accommodating stacks of the different sheets to be collated.

The ring of bins 5 around the periphery of the table 3 is interrupted at one point by a receiving tray 6 consisting of a flat platform 7 which is mounted, with its major plane inclined to the horizontal, on a support 8 fixed rigidly to the table 3. The tray carries guide rods 9 extending perpendicular to its major plane.

Two collecting stations 11 are spaced from each other around the periphery of the table 3 and each comprises a support member 12 which is rigidly secured to, and extends radially outwards from, the base 2 such that it projects to a point outside the peripheral edge of the table. Supported adjacent the free end 13 of the member 12 is an arm 14, a first portion 15 of which has one end secured to the member 12 and projects vertically upwards. A second portion 16 of the arm is bent at right angles to the first portion 15 such that it projects radially inwardly towards the centre of the table 3 and over the ring of bins 5, whilst a third portion 17 is bent at right angles to both the first and second portions to be substantially parallel to the plane of the table and disposed over a portion of the ring of bins. A collecting shoe 18 is suspended by means of resilient lugs 19 from the third portion 17 of the arm 14 so that the shoe is free to tilt in any direction and lies over substantially the same portion of the ring of bins 5 as does the third portion of the arm. The collecting shoe 18 is suspended at such a height above the ring of bins 5 that its lower surface 20 slides over a roller 21 mounted on the upper edge 22 of each partition 4 as the table 3 is rotated by the motor. Each roller 21 is conically tapered, narrowing towards the centre of the table, and is mounted to rotate about a spindle 23 which is secured to the partition 4 by means of bearing projections 24 such that it lies in the major plane of, and is parallel to the upper edge 22 of, the partition 4. In the absence of sheets in a bin 5, the respective tapered rollers 21 of the two adjacent partitions defining the bin are rotated by the sliding contact between the lower surface 20 of the shoe 18 and the rollers. The body of each shoe 18 may be made of a friction material or the shoe may be provided on its lower surface 20 with a layer of such a material. A rubber or foamed plastics material of sufficient rigidity to entrain the sheets may be used for example.

Figure 2:
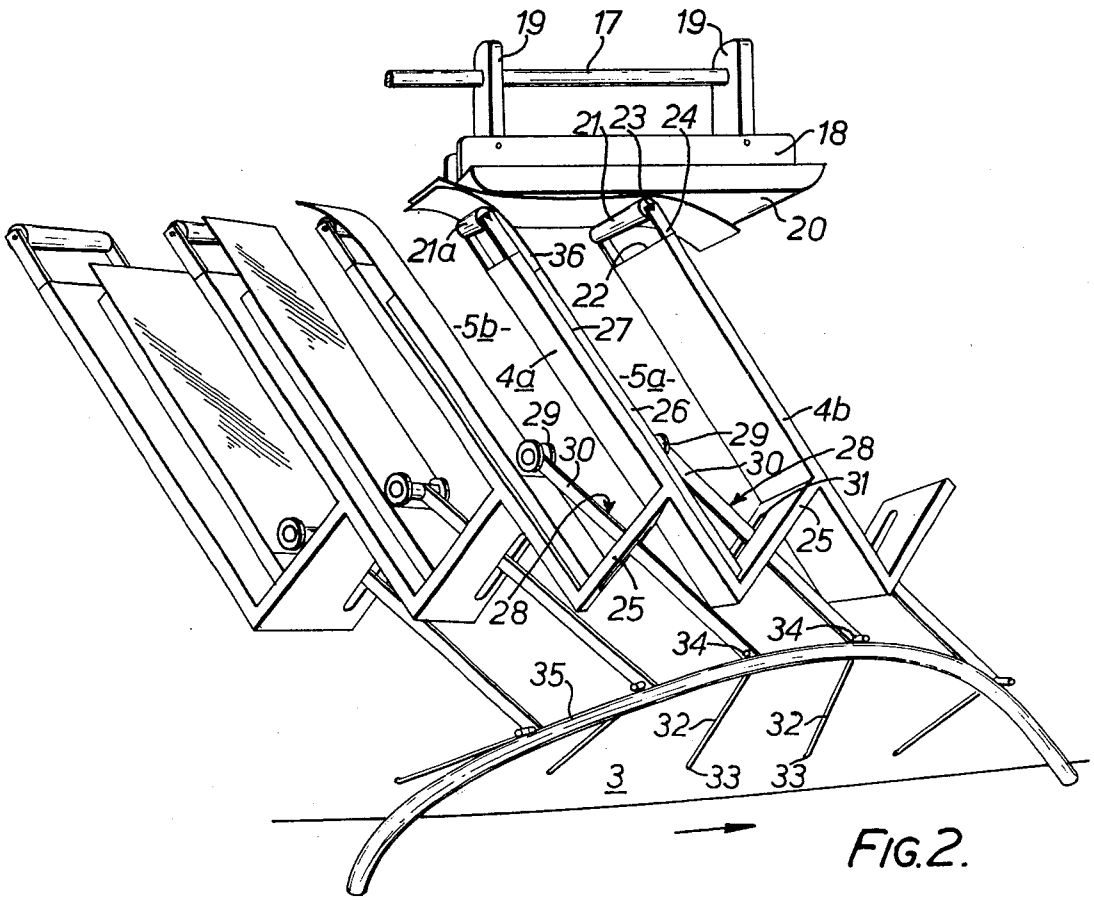
FIG. 2 is a perspective view of a preferred form of collecting arrangement comprising part of the machine shown in FIG. 1; and, FIGS. 3 and 4 are a perspective side view and a schematic diagram, respectively, of a preferred form of detector system for use in the collating machine of the present invention.

Referring now to FIG. 2, adjacent partitions defining bins 5*a*, 5*b* are spaced by means of panels 25 secured for example to the bottom of one partition 4*a* and to a point intermediate the top and bottom ends of an adjacent partition 4*b* such that the major plane of the panel is substantially perpendicular to those of both the partitions 4*a*, 4*b*, as shown in FIG. 2, to form a base for supporting a stack of sheets 26 accommodated in the bin 5*a*. The stack 26 lies in the bin 5*a* against the upper face 27 of the partition 4*a* below the level of the rollers 21. A feed device 28 is provided for each bin 5*a*, 5*b* etc. and comprises a friction pad 29 mounted on the upper end of a feeder arm 30 which projects through a slot 31 in the base panel 25 of the bin 5*a* and whose lower end is pivotally secured to one end of a lever arm 32. The other end of the lever arm 32 is pivotally mounted in a bearing 33 set into the edge of the circular table 3 and a cam follower 34 is provided at the pivot between the two arms 30, 32 to project radially outwards with respect to the table. Each cam follower 34 is arranged such that, on rotation of the table, it rides up an arcuate cam member 35, supported at one end on the radially extending support member 12 to lie tangentially to the table 3, as its associated bin approaches and passes under the collecting shoe 18. The consequent upward movement of the feeder arm 30 causes the friction pad 29 engaging the outermost sheet 36 of the stack 26 in the bin 5*a* to move upwardly and to feed the sheet 36 upwards so that the sheet lies with its underside engaging the roller 21*a* just before the roller passes under the shoe 18. A spring strip 37 (FIG. 3) extending upwardly above the partition behind the roller underlies the sheet 36 in its position against the roller to prevent the leading edge of the sheet from bending downwardly into the next bin 5*b*.

The spacing between the adjacent partitions 4, 4*a*, 4*b* is such that, in relation to the length of the sheets 26 in each bin 5, 5*a*, 5*b*, the leading edge of an entrained outermost sheet 36 being moved out of its bin reaches the upwardly displaced, outermost sheet of the stack accommodated in the next bin 5*b* well before the trailing edge of the first entrained sheet passes over the tapered roller 21*a* of the bin from which said first sheet is being drawn. As the table 3 continues to rotate, the entrained outermost sheet 36, acted upon by the shoe 18, itself entrains the upwardly fed outermost sheet from the next bin 5*b* which in turn entrains the upwardly fed outermost sheet from the following bin and so on until a set of sheets is formed beneath the shoe. Due to the frictional adhesion between the lower surface 20 of the shoe 18 and the uppermost sheet of the set and the very much lower friction between the lowermost sheet of the set and the surface of the rollers 21, the set remains as a whole with the shoe until it lies over the platform 7 of the receiving tray 6, whereupon the set is deposited on the platform. When two collecting stations 11 are employed, as is preferred, it is convenient for separately collated sets to be divided from each other on the tray 6 by a dividing sheet which is collected at the end of each set collated and of which a stack is accommodated in the bin 5 following that containing the last sheet of the set.

However, collated sets may be divided from each other on the tray 6 by other means. For example, the collecting shoe may be pivoted alternately through a predetermined angle, e.g. 90°, about a vertical axis through the shoe such that adjacent sets stacked on the tray are offset with respect to each other by said angle and thus every other set is aligned with respect to each other. Another way of separating the stacked sets from each other is to allow a suitably shaped peripheral edge of the platform 7 to coact with a cam surface (not shown) associated with each collecting station 11 to rotate the tray 6 through 90° as each station approaches the tray.

In order to eliminate any tendency for the sheets to be unevenly acted upon by the shoe 18 and twisted out of alignment with respect to the set, each roller 21 must have its rotational axis aligned on an exact radius of the table 3 and have its conical surface tapered to compensate for the speed differential of radially spaced points around the table.

In order to provide a warning that a stack 26 of sheets in a bin 4 has been used up before the stacks in the other bins have all been collated, a detector system is incorporated in the collating machine 1 to stop the rotation of the circular table 3 by switching off the electric supply to the motor mounted in the base 2 so that an operator can then replenish the empty bin with another stack of sheets.

Figure 3:
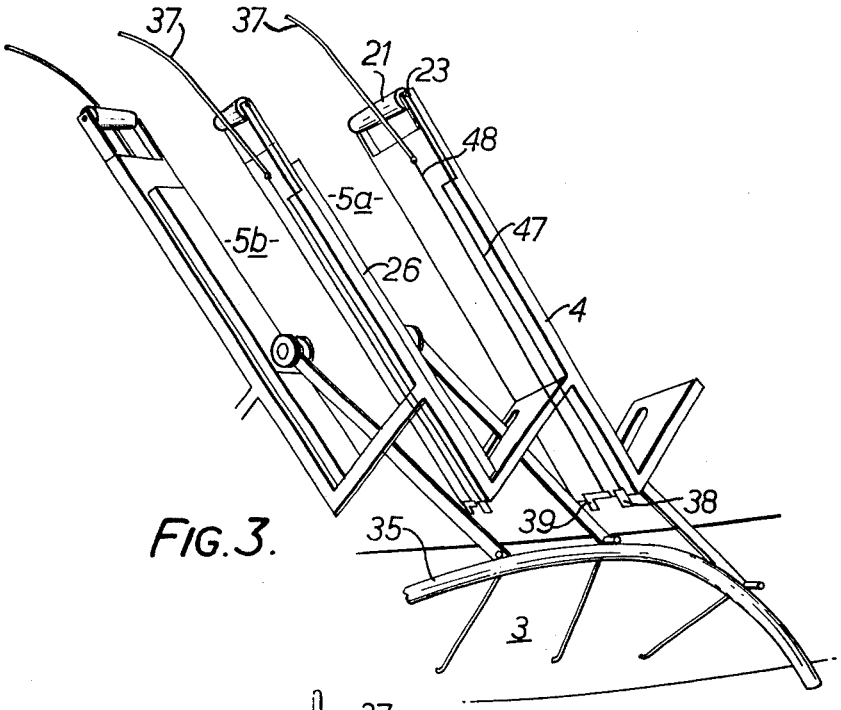
Figure 4:
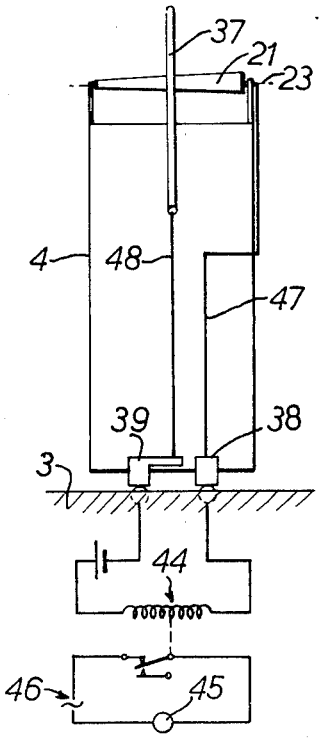

Referring now to FIGS. 3 and 4, the detector system utilizes each spring strip 37 as an electrical contact to complete a low voltage circuit for tripping an electromagnetic relay connected in series with the motor 45 and its power supply 46. Each tapered roller 21 is moulded from a plastics material, such as polypropylene, and has the whole of its outer surface chromium plated. Electrical conductors 47, 48 connect the roller spindle 23, which is made of a conductive material and is in electrical engagement with the chromium plated surface of the roller 21, and the spring strip 37 to respective flexible spring contacts 38, 39 secured to the base of the partition 4. Each spring contact 38, 39 is positioned such that it bears against a respective conductive insert 40, 41 which is set into a groove around the upper surface of the table 3, the two inserts being connected across a 6 volt d.c. power supply 43 and an electromagnetic relay 44.

During normal operation of the collating machine 1 an outermost sheet (not shown) fed from a stack 26 of sheets in a bin 5*a* bears on a respective spring strip 37 such that as this sheet is entrained by the collecting shoe (not shown) the strip 37 is bent horizontally, the upwardly displaced, outermost sheet of the next bin 5*b* insulating said bent strip from the roller 21 of the next bin. If, however, the next bin 5*b* is empty then the spring strip 37 will be brought into direct contact with the roller 21 of the next bin by the action of the shoe and the endtrained sheet from bin 5*a* such that the 6 volt circuit is completed and the motor power supply 46 is switched off to stop rotation of the table 3. An operator may then check visually or by means of a monitor (not shown) connected to the detector system which bin is empty. After the empty bin has been replenished with another stack of sheets, the operator may then re-start the motor 45 in order that the collating operation can continue.

One advantage of the detector system described above is that it can also be used to detect when an entrained sheet from a bin pulls up and entrains at least one other sheet from the same bin. The weight of the or each subsequently entrained sheet from a single bin will urge the spring strip 37 associated with that bin down onto the roller 21 of the next bin after the next bin has passed under the collecting shoe, thereby completing the 6 volt circuit and hence stopping rotation of the table 3. This indicates either that a bin is empty or that at least two sheets have been fed from the same bin.

In order that a given bin may be left empty, if required, and to prevent the table from stoping every time the collecting shoe passes over the empty bin, the feeder arm 30 associated with that bin may be lifted up inside the bin into an inoperative position such that its cam follower 34 cannot engage the arcuate cam member 35. In its inoperative position the feeder arm 30 serves to disconnect the contact 39 from the conductor 48 so that electrical continuity between the empty bin and the previous bin is prevented when the spring strip of the previous bin is urged against the roller of the empty bin.

Although the embodiment described above uses two collecting shoes, the invention is equally applicable to the use of only one or more than two shoes.

I claim:

1. A collating machine comprising:

a plurality of bins located in series on an arc of a circle and each arranged to hold a stack of sheets;

a sheet collecting device adjacent to said bins;

drive means arranged to effect relative rotary movement between said plurality of bins and said collecting device;

frictional sheet feeding means co-acting with the sheets of said bins for causing single sheets of individual ones of said bins to be collected progressively in a stack at said collecting device to form a collated set as said relative rotary movement occurs; and receiver means positioned along said arc in between two successive bins, said receiver means for receiving collated sets of sheets from said sheet collecting device.

2. A machine as claimed in claim 1, in which said sheet collecting device is mounted in a stationary position and said plurality of bins are rotatable around said circular arc relative to said sheet collecting device.

3. A machine as claimed in claim 1, in which each said bin is formed between an adjacent pair of a plurality of partitions which are rigidly mounted around a circular support member and which are each inclined at a common angle to a plane perpendicular to the axis of rotational symmetry of said support member.

4. A machine as claimed in claim 1, in which said sheet collecting device comprises a collecting shoe resiliently suspended above the arc of bins and having at least one surface facing said bins of a material which frictionally holds an extracted sheet during said relative rotary movement.

5. A machine as claimed in claim 1, in which each of said bins is provided with a resilient strip element projecting from the bin towards said sheet collecting device to prevent the leading edge of a sheet being extracted from the bin from passing into the next following bin.

6. A machine as claimed in claim 1, which includes detector means operative to stop said relative rotary movement when a bin becomes empty said detector means also operative to stop said relative rotary movement if a sheet extracted from a bin entrains the next sheet from the same bin in partial overlapping relationship.

7. A machine as claimed in claim 1 wherein said frictional sheet feeding means includes a plurality of friction means, a different said friction means associated with each of said plurality of bins, each said friction means for feeding the uppermost sheet of a stack of sheets in its associated bin to a position in which said sheet collecting device entrains said displaced sheet, and wherein said frictional sheet feeding means also includes a plurality of rollers, each said bin having a different one of said rollers associated therewith towards which and over which the sheets displaced by said plurality of friction means are fed, each said roller being rotatable about a different axis lying on a radius of said arc and cooperating with said sheet collecting device to entrain the displaced sheets between the roller and said sheet collecting device, and wherein each of said bins is provided with a resilient strip element projecting from the bin towards said sheet collecting device to prevent the leading edge of a sheet being extracted from the bin from passing into the next following bin, each said resilient strip element and at least the surface of each said roller being electrically conductive and each strip element projecting from its bin by an amount greater than the distance between adjacent ones of said rollers whereby it can be bent to bridge the gap to the next roller, the strip elements and rollers being arranged for a connection into an electrical circuit which includes means for disconnecting said drive means.

8. A machine as claimed in claim 1, in which said receiver means and said sheet collecting device are arranged for relative movement each time that they pass each other so that successive collated sets deposited at said receiver means are offset at an angle relative to one another.

9. A machine as claimed in claim 1 wherein said sheet feeding means includes a plurality of friction means, a different said friction means associated with each of said plurality of bins, each said friction means for feeding the uppermost sheet of a stack of sheets in its associated bin to a position in which said sheet collecting device entrains said displaced sheets.

10. A machine as claimed in claim 9 wherein each said friction means comprises a pivotable linkage secured at a first end externally of the bin to an element fixed relative to the bin and carrying at a second end internally of the bin a friction pad engageable with the uppermost sheet of a stack of sheets, and mechanical means for moving said linkage in response to said relative rotary movement to cause said friction pad to move within the bin and feed the uppermost sheets toward said sheet collecting device.

11. A machine as claimed in claim 10, wherein said second purely mechanical means comprises cam means engageable with said pivotable linkage for causing said movement of said linkage, said cam means being elongated so that any time it is in engagement with the linkages of a plurality of successive bins to affect progressive sheet displacement within said plurality of bins.

12. A machine as claimed in claim 9 wherein said sheet feeding means includes a plurality of rollers, each said bin having a different one of said rollers associated therewith towards which and over which the sheets displaced by said friction means are fed, each said roller being rotatable about a different axis lying on a radius of said arc and cooperating with said sheet collecting device to entrain the displaced sheets between said rollers and said sheet collecting device.

13. A machine as claimed in claim 12, in which each roller is frusto-conical narrowing towards the centre of curvature of said arc.

14. A collating machine comprising:

a plurality of bins located in series on an arc of a circle, each of said plurality of bins arranged to hold a stack of sheets;

a sheet collecting device adjacent to said bins;

drive means arranged to effect relative rotary movement between said plurality of bins and said collecting device;

frictional means for causing single sheets of individual ones of said bins to be collected progressively in a stack at said collecting device to form a collated set as said relative rotary movement occurs, said frictional means comprising:

a plurality of friction means, a different said friction means associated with each of said plurality of bins, each said friction means feeding the uppermost sheet of a stack of sheets in its associated bin to a position wherein said sheet collecting device entrains said displaced sheet; and a plurality of rollers, each said bin having a different one of said rollers associated therewith towards which and over which the sheets displaced by said plurality of friction means are fed, each said roller being rotatable about a different axis lying on a radius of said arc and cooperating with said sheet collecting device to entrain the displaced sheets between said rollers and said sheet collecting device.

15. Apparatus in accordance with claim 14 wherein each said friction means comprises a pivotable linkage secured at a first end externally of the bin to an element fixed relative to the bin and carrying at a second end internally of the bin a friction pad engageable with the uppermost sheet of a stack of sheets, and mechanical means for moving said linkage in response to said relative rotary movement to cause said friction pad to move within the bin and feed the uppermost sheets toward said sheet collecting device.

* * * * *